US009890494B2

(12) United States Patent
Jang

(10) Patent No.: US 9,890,494 B2
(45) Date of Patent: Feb. 13, 2018

(54) WASHING MACHINE CONTROLLER

(71) Applicant: LG ELECTRONICS INC., Seoul (KR)

(72) Inventor: Yongwoon Jang, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 14/987,975

(22) Filed: Jan. 5, 2016

(65) Prior Publication Data

US 2016/0194806 A1 Jul. 7, 2016

(30) Foreign Application Priority Data

Jan. 5, 2015 (KR) ..... 10-2015-0000822

(51) Int. Cl.
*D06F 39/00* (2006.01)
*D06F 35/00* (2006.01)
*D06F 33/02* (2006.01)

(52) U.S. Cl.
CPC ..... *D06F 39/005* (2013.01); *D06F 33/02* (2013.01); *D06F 35/008* (2013.01)

(58) Field of Classification Search
CPC ..... D06F 33/02; D06F 35/008; D06F 39/005
See application file for complete search history.

(56) References Cited

U.S. PATENT DOCUMENTS

2006/0162743 A1 7/2006 Park
2008/0276656 A1 11/2008 Kitamura et al.
2008/0308127 A1* 12/2008 Padtberg ..... A47L 15/0057 134/18
2009/0095028 A1* 4/2009 Hoppe ..... D06F 39/005 68/12.04
2012/0144872 A1 6/2012 Kappler et al.
2014/0041695 A1 2/2014 Ellingson et al.

FOREIGN PATENT DOCUMENTS

CN 101098994 1/2008
CN 102383287 3/2012
WO 2012/089628 7/2012

OTHER PUBLICATIONS

International Search Report and Written Opinion in International Application No. PCT/KR2016/000071, dated Apr. 26, 2016, 10 pages.
Chinese Office Action in Chinese Application No. 201610006842.7, dated Jul. 19, 2017, 13 pages (with English translation).

* cited by examiner

*Primary Examiner* — Joseph L Perrin
(74) *Attorney, Agent, or Firm* — Fish & Richardson P.C.

(57) ABSTRACT

A washing machine includes an outer tub that is configured to holding water. The washing machine includes an inner tub that is configured to exchange water with the outer tub and that is configured to rotate. The washing machine includes a pulsator that is located in a lower portion of the inner tub and that is configured to rotate. A method to operate the washing machine includes the actions of, each time that a wash cycle runs after a previous self-cleaning course, storing a cumulative number of times the wash cycle has run since the previous self-cleaning course. The actions further include selecting a subsequent self-cleaning course. The actions further include configuring settings of the subsequent self-cleaning course based on the stored cumulative number of times the wash cycle has run since the previous self-cleaning course. The actions further include conducting the subsequent self-cleaning course according to the configured settings.

13 Claims, 9 Drawing Sheets

WASHING MACHINE CONTROLLER

CROSS-REFERENCE TO RELATED APPLICATION

This application claims priority to Korean Patent Application No. 10-2015-0000822, filed on Jan. 5, 2015 in the Korean Intellectual Property Office, whose entire disclosure is incorporated herein by reference.

FIELD

The present disclosure relates to a control method for a washing machine.

BACKGROUND

Generally, a washing machine is a machine used to wash laundry by dissolving detergent, causing water to circulate by the rotation of a wash tub and an impeller, and applying the force of the impeller. The washing machine carries out a washing, rinsing, and/or spin drying process so as to remove dirt from laundry (hereinafter, 'fabrics') by using the action of water and detergent.

A typical washing machine includes a casing forming the outer appearance of the washing machine, an outer tub accommodated in a suspended position within the casing, and an inner tub rotatably provided inside the outer tub.

The inner tub and outer tub of the washing machine get contaminated with various factors such as scale, water stains, soap scum, etc. due to repeated use over the years.

SUMMARY

According to an innovative aspect of the subject matter described in this application, a control method for a washing machine that includes an outer tub that is configured to holding water; an inner tub that is located within the outer tub, that is configured to exchange water with the outer tub, and that is configured to rotate; and a pulsator that is located in a lower portion of the inner tub and that is configured to rotate includes the actions of, each time that a wash cycle runs after a previous self-cleaning course, storing a cumulative number of times the wash cycle has run since the previous self-cleaning course; selecting a subsequent self-cleaning course; configuring settings of the subsequent self-cleaning course based on the stored cumulative number of times the wash cycle has run since the previous self-cleaning course; and conducting the subsequent self-cleaning course according to the configured settings.

The method may include one or more of the following optional features. The action of configuring the settings of the subsequent self-cleaning course includes setting a length of time of the subsequent self-cleaning course based on the stored cumulative number of times the wash cycle has been run since the previous self-cleaning course. The length of time of the subsequent self-cleaning course is directly related to the cumulative number of times the wash cycle has run since the previous self-cleaning course. The washing machine further comprises a display part. The actions further include displaying the length of time of the subsequent self-cleaning course on the display part. The action of displaying the length of time of the self-cleaning course is in response to selecting the subsequent self-cleaning course. The washing machine further comprises an input part. The action of selecting the subsequent self-cleaning course comprises receiving a selection of the subsequent self-cleaning course through the input part.

The actions further include, after displaying the length of time of the self-cleaning course through the display part, configuring the input part to receive an adjustment to the length of time of the subsequent self-cleaning course. The actions further include receiving, through the input part, an adjusted length of time of the subsequent self-cleaning course. The action of conducting the subsequent self-cleaning course includes conducting the subsequent self-cleaning course based on the adjusted length of time of the subsequent self-cleaning course. The washing machine further includes a storage part that is configured to assign the cumulative number of times the wash cycle has run since the previous self-cleaning course into one of one or more ranges according to a predetermined criterion and that is configured to store information about the settings for the subsequent self-cleaning course for each of the one or more ranges. The information about the settings for the subsequent self-cleaning course for each of the one or more ranges includes information about strokes of the subsequent self-cleaning course and information about a length of time of each stroke.

The action of configuring the settings of the subsequent self-cleaning course further includes determining a range, from the one or more ranges, in which the cumulative number of times the wash cycle has run since the previous self-cleaning course is located; and configuring the settings of the subsequent self-cleaning course based on the determined range. The self-cleaning course comprises at least one of a soaking stroke that includes providing water to the outer tub and retaining water in the outer tub for a predetermined period of time, or a contaminant removal stroke that includes rotating at least one of the inner tub or the pulsator and draining water from the outer tub. The settings for the subsequent self-cleaning course comprise settings for a length of time of the soaking stroke for each of the one or more ranges.

The length of time of the soaking stroke for each of the one or more ranges is directly related to the cumulative number of times the wash cycle has run since the previous self-cleaning course. The soaking stroke includes providing water to fill the outer tub and the inner tub to a first level; retaining water in the outer tub and the inner tub for a lower portion soaking time; providing water to fill the outer tub to a second level that is higher than the first level; and repeatedly rotating and stopping the inner tub for a given period of time after an upper portion soaking time and the lower portion soaking time. A duration of the soaking stroke comprises at least the lower portion soaking time. Based on the cumulative number of times the wash cycle has run since the previous self-cleaning course being less a reference value, configuring the settings of the subsequent self-cleaning course includes providing water to fill the outer tub and the inner tub to a first level; and retaining water in the outer tub and the inner tub for a lower portion soaking time.

Based on the cumulative number of times the wash cycle has run since the previous self-cleaning course being equal to or greater than a reference value, configuring the settings of the subsequent self-cleaning course includes providing water to fill the outer tub and the inner tub to a first level; retaining water in the outer tub and the inner tub for a lower portion soaking time; providing water to fill the outer tub to a second level that is higher than the first level; and repeatedly rotating and stopping the inner tub for a given period of time after an upper portion soaking time and the lower portion soaking time. The contaminant removal stroke includes overflowing water from the outer tub to the inner tub by rotating the inner tub; repeatedly rotating and stopping the inner tub; and reciprocating the pulsator while the inner tub is stopped. The contaminant removal stroke further includes, after reciprocating the pulsator, draining water from the outer tub. The actions further include, after draining water from the outer tub providing water to the outer tub; overflowing water from the outer tub to the inner tub by rotating the inner tub; repeatedly rotating and stopping the inner tub; and reciprocating the pulsator while the inner but is stopped.

According to another innovative aspect of the subject matter described in this application, a control method for a washing machine that an outer tub that is configured to holding water; an inner tub that is located within the outer tub, that is configured to exchange water with the outer tub, and that is configured to rotate; and a pulsator that is located in a lower portion of the inner tub and that is configured to rotate includes the actions of, each time that a wash cycle runs after a previous self-cleaning course, storing a cumulative number of times the wash cycle has run since the previous self-cleaning course; selecting a subsequent self-cleaning course; setting a self-cleaning time based on the stored cumulative number of times the wash cycle has run since the previous self-cleaning course; and conducting the subsequent self-cleaning course for the set self-cleaning time.

The method may include one or more of the following optional features. The self-cleaning time is proportional to the cumulative number of times the wash cycle has run since the previous self-cleaning course. The washing machine further comprises a display part. The actions further include displaying the self-cleaning time on the display part.

The present disclosure provides a control method for a washing machine that changes strokes of a self-cleaning course or adjusts the length of time of each stroke, depending on how heavily the washing machine is contaminated.

Another aspect of the present disclosure is directed to providing a control method for a washing machine that can estimate how heavily the washing machine is contaminated.

DETAILED DESCRIPTION

Figure 1:
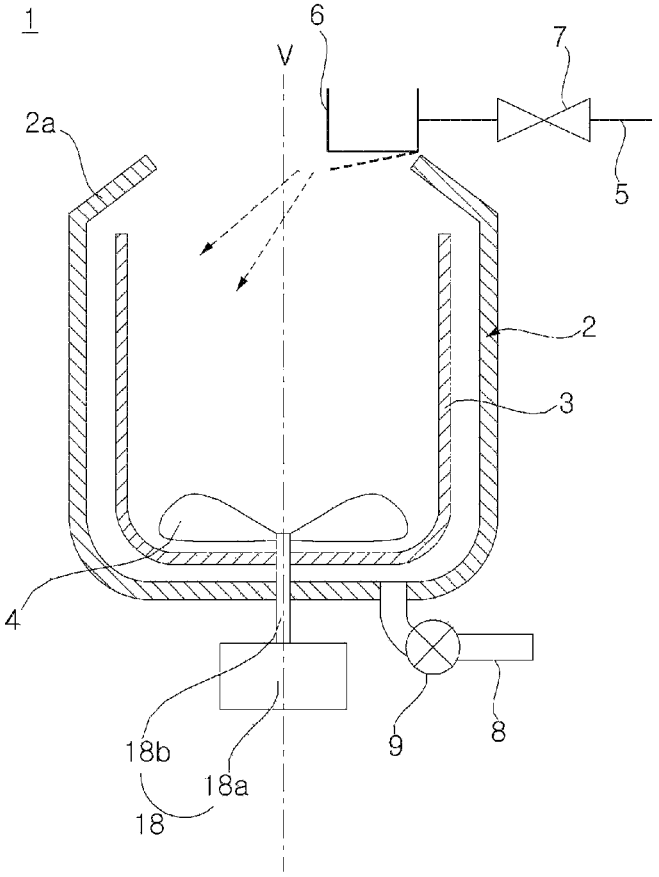
FIG. 1 is a schematic of an example washing machine.
Figure 2:
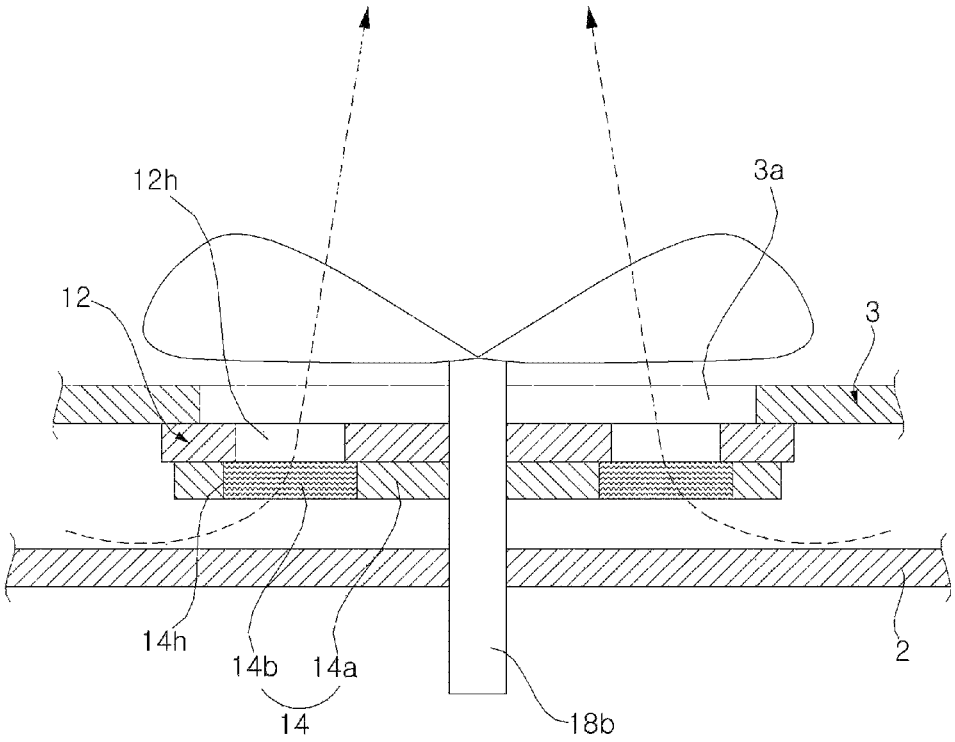
FIG. 2 is an enlarged view of an example part of an example washing machine.
Figure 3:
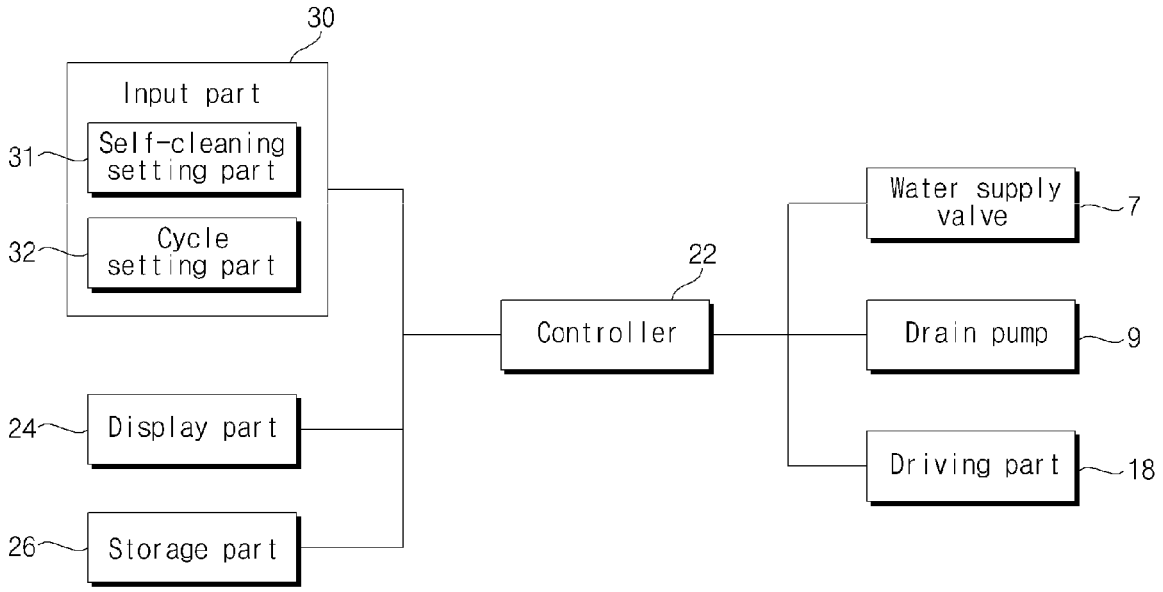
FIG. 3 is a block diagram of a control relationship among main components of a washing machine.

FIG. 1 illustrates an example. FIG. 2 illustrates an example part of an example washing machine. FIG. 3 illustrates example main components of a washing machine.

Referring to FIGS. 1 to 3, the washing machine 1 includes an outer tub 2 for containing water, an inner tub 3 that holds laundry and is rotatably located inside the outer tub 2, and a pulsator 4 rotatably provided in the lower portion of the inner tub 3.

The outer tub 2 may be located within a casing forming the outer appearance of the washing machine 1 and suspended within the casing by a suspension so as to counteract vibration caused by the rotation of the inner tub 3. The inner tub 3 rotates on a vertical axis V. The top of the outer tub 2 is opened to let fabrics into the inner tub 3 from above. A ring-shaped cover 2*a* may be provided at the top of the outer tub 2. When the inner tub 3 rotates at a moderate speed, a flow of water may rise higher than the top edge of the inner tub 3 along the space between the outer tub 2 and the inner tub 3 and be guided along the ring-shaped cover 2*a* to pour into the inner tub 3.

A control panel may be located on the casing. The control panel may include an input part 30 for choosing various settings (e.g., course, time, etc.) or receiving input of these settings from the user to run the washing machine 1, and a display part 24 for displaying the operational status (e.g., progress of course, remaining time, etc.) of the washing machine 1.

The input part 30 may include a self-cleaning setting part 31 for receiving input of settings for a self-cleaning course from the user. In response to instructions given through the self-cleaning setting part 31, the self-cleaning course may be conducted or stopped, or various settings for the self-cleaning course may be changed.

The input part 30 may include a cycle setting part 32 for receiving input of settings for a wash cycle from the user. The wash cycle is a series of processes for removing dirt from laundry by conducting washing, rinsing, and/or spin drying. A single wash cycle is defined as a period during which a certain course is selected through the cycle setting part 32 and laundry is done by a series of processes including washing, rinsing and/or spin drying according to a preset algorithm.

A controller 22 controls the operation of different types of devices of the washing machine 1, and may include a microprocessor. Unless specified otherwise, these devices will be construed as being controlled by the controller 22 in the description of the control method for the washing machine.

The display part 24 displays the operational status of the washing machine to let the user see it, and may include a display composed of a diode or touchscreen. Available courses, the current course, the time remaining until completion of the current course, etc. may be displayed through the display part 24.

A storage part 26 stores data readable by the controller 22, and may include HDD (hard disk drive), SSD (solid state disk), SDD (solid disk drive), ROM, RAM, CD-ROM, a magnetic tape, a floppy disk, optical data storage, etc. The storage part 26 may store various data required to run the washing machine, for example, the cumulative number of times the wash cycle has been run (hereinafter, 'cumulative number of times the cycle has been run'). The controller 22 may calculate the cumulative number of times the cycle has been run each time the wash cycle is completed and record it in the storage part 26.

A plurality of through holes may be formed on the sidewall of the inner tub 3 so that water can circulate between the outer tub 2 and the inner tub 3. Also, an opening 3*a* may be formed at the bottom of the inner tub 3, and a hub 12 under the inner tub 3 may be attached around the opening 3*a*.

A driving part 18 may include a motor 18*a* that delivers torque and a clutch that connects the motor 18*a*'s rotating shaft 18*b* to the hub 12 or disconnect it from the hub 12. The rotating shaft 18*b* of the motor 18*a* is always in engagement with the pulsator 4. Accordingly, while the rotating shaft 18*b* is engaging with the hub 12 by the clutch, the inner tub 3 and the pulsator 4 rotate together. On the contrary, while the rotating shaft 18*b* is disengaged from the hub 12, the inner tub 3 remains stopped and only the pulsator 4 rotates. Hereinafter, rotating the inner tub 3 and the pulsator 4 together may be defined as 'full spin mode', and rotating only the pulsator 4 while the inner tub 3 remains stopped is defined as 'agitation mode'. In some implementations, in the agitation mode, the pulsator 4 may rotate alternately in two opposite directions. The following implementations will be described with an example in which the agitation mode involves rotating the pulsator 4 alternately in two opposite directions. In some implementations, the agitation mode may involve repeatedly rotating or stopping the pulsator 4 in a given direction or continuously rotating the pulsator 4 in one direction.

The speed of the motor 18*a*'s can be controlled. For example, the motor 18*a* may be a BLDC (brushless DC motor). The technique of controlling the rotation speed of the inner tub 3 or pulsator 4 by using a motor such as BLDC whose speed can be controlled is already widely known in washing machine technology, so a detailed description thereof will be omitted.

The pulsator 4 may include a plurality of ribs that extend radially from the center and generate a flow of water. By designing the ribs in a proper shape, a flow of water that moves upward when the pulsator 4 rotates may be formed inside the inner tub 3. Also, a plurality of through holes through which the upward-moving flow of water passes may be formed in the pulsator 4. For example, the arrows with a dotted line in FIG. 2 indicate that a flow of water is passing through the through holes from under the pulsator 4 and rising.

A plurality of through holes 12*h* arranged in a circumferential direction around the rotating shaft 18*b* may be formed in the hub 12. When the inner tub 3 or the pulsator 4 rotates, a flow of water moving from the outer tub 2 into the inner tub 3 via the through holes 12*h* may be formed. The arrows with a dotted line in FIG. 2 schematically represent this flow of water.

A filter 14 for filtering out impurities contained in the flow of water passing through the through holes 12*h* may be provided. The filter 14 may include a filter frame 14*a* with filter holes 14*h* at positions corresponding to the through holes 12*h* and a collection bag 14*b* with a mesh structure that is fixed at the filter frame 14*a* and filters the flow of water passing through the filter holes 14*h*. In some implementations, the filter 14 may be attached to the bottom of the hub 12.

Also, the washing machine 1 may include a water supply channel 5 connected to an external water supply source such as a water tap, a water supply valve 7 for regulating the water supply channel 5, a detergent box 6 provided on the water supply channel 5, a drainage channel 8 for draining the water in the outer tub 2, and a drain pump 9 provided on the drainage channel 8.

Figure 4:
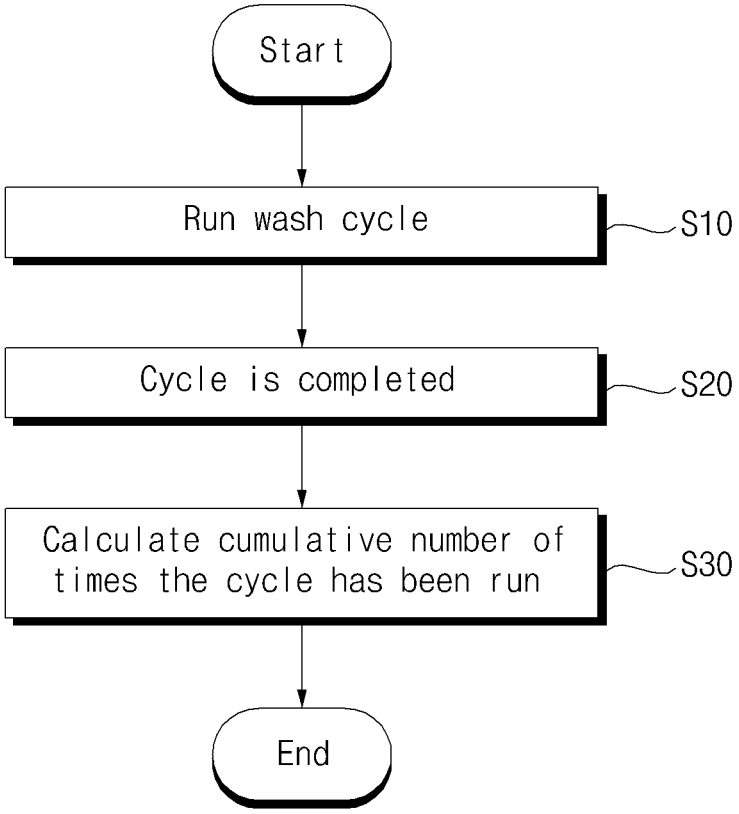
FIG. 4 is an example control method for calculating a cumulative number of times that a wash cycle of a washing machine has run.
Figure 5:
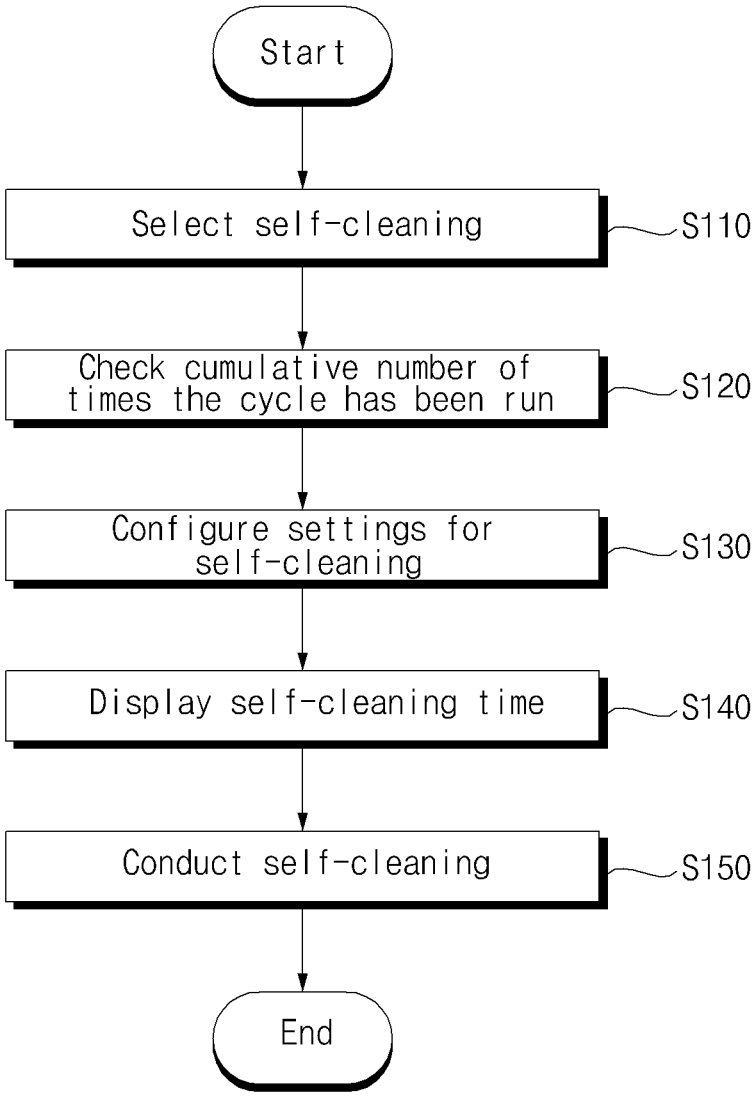
FIG. 5 is an example control method for a self-cleaning process of a washing machine.

FIGS. 4 and 5 illustrate example control methods for example washing machines.

The steps illustrated in FIG. 4 may be carried out each time the wash cycle is run. When the wash cycle is run according to settings input through the cycle setting part 32 (S10), washing, rinsing and/or spin drying are carried out according to a preset washing algorithm and then the wash cycle is completed (S20). Each time the wash cycle is run, the controller 22 may calculate the cumulative number of times the wash cycle has been run and record it in the storage part 26 (S30). The cumulative number of times the wash cycle has been run recorded in the storage part 26 is not erased but kept even if the washing machine is powered off.

In some implementations, the number of times the wash cycle has been run since the last time the self-cleaning course was conducted is calculated. If the self-cleaning course is conducted afresh by selecting through the self-cleaning setting part 31, the cumulative number of times the wash cycle has been run recoded in the storage part 26 is erased.

Referring to FIG. 5, the self-cleaning course may be selected through the self-cleaning setting part 31 (S110). When the self-cleaning course is selected, the controller 22 may configure the self-cleaning course depending on the cumulative number of times the cycle has been run stored in the storage part 26. More specifically, the controller 22 may check the cumulative number of times the cycle has been run recorded in the storage part 26 (S120) and configure settings for the self-cleaning course depending on the recorded cumulative number of times the cycle has been run (S130). The settings for the self-cleaning course may include settings for self-cleaning time and settings for a combination of strokes of the self-cleaning course. In some implementations, the self-cleaning time may be the total length of time of the self-cleaning course or the length of time taken for each stroke of the self-cleaning course (hereinafter, also referred to as 'length of time of each stroke').

The self-cleaning time set in the step S130 may be displayed through the display part 24 (S140). While the following description will be made with an example in which the display part 24 displays the total length of time of the self-cleaning course, the display part 24 may display the length of time of each stroke.

Afterwards, the self-cleaning course may be conducted (S150). As the self-cleaning course proceeds, the controller 22 may allow the display part 24 to display the time remaining until completion of the self-cleaning course.

FIGS. 6 to 10 illustrate example self-cleaning cycles of a self-cleaning course. Hereinafter, the cycles, or strokes, of the self-cleaning course will be described with reference to FIGS. 6 to 10. In the drawings, the arrows with a solid line represent the direction the inner tub 3 rotates, and the arrows with a dotted line represent the direction the pulsator 4 rotates.

The self-cleaning course may include at least either a soaking stroke for feeding water into the outer tub 2 and retaining it for a predetermined period of time or a contaminant removal stroke for rotating at least either the inner tub 3 or the pulsator 4 and then draining the water from the outer tub 2 at least once.

In some implementations, the self-cleaning course is conducted without fabrics loaded in the inner tub 3. Usually, washing machines are equipped with a function of detecting the amount of fabrics loaded in the inner tub 3 (hereinafter, 'amount of fabrics'), and a lot of means or methods for detecting the amount of fabrics are well-known. When the self-cleaning course is selected through the self-cleaning setting part 31, the washing machine may carry out a step of detecting the amount of fabrics under control of the controller 22. In some implementations, once it is confirmed that there are no fabrics loaded in the inner tub 3, the strokes of the self-cleaning course may be conducted. If the presence of fabrics in the inner tub 3 is detected through the step of detecting the amount of fabrics, the controller 22 does not conduct the self-cleaning course, but instead allows the display part 24 to display a message requesting to remove the fabrics or, in some implementations, the controller 22 may allow a speaker or boozer to output an alert or guidance message.

The soaking stroke is a step of soaking soils, dirt, or debris (for example, lint, impurities separated from clothes, scale, etc.) stuck on the outer tub 2, inner tub 3, pulsator 4, hub 12, and/or filter 14 by keeping the outer tub 2 filled with water.

Figure 6:
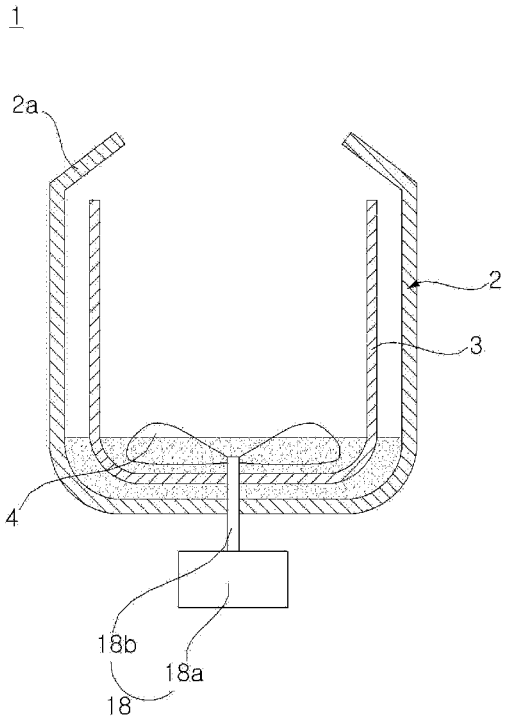
FIGS. 6 to 10 are cross-sectional views of example self-cleaning cycles of a self-cleaning course.
Figure 7:
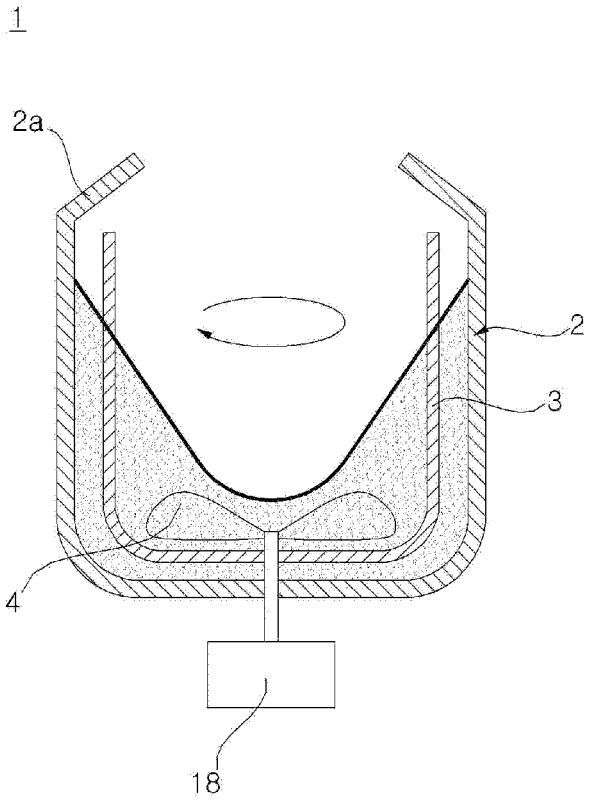

The soaking stroke may include at least either an upper portion soaking step or an upper and lower portion soaking step. FIG. 6 illustrates an example self-cleaning pattern in a lower portion soaking step. FIG. 7 illustrates an example self-cleaning pattern in an upper and lower portion soaking step.

Referring to FIG. 6, water is fed to a first level into the outer tub 2 in the lower portion soaking step. The washing machine 1 may include a detection means for detecting the water level in the outer tub 2. In some implementations, when the detection means detects that the water level in the outer tub 2 reaches the first level after the water supply valve 7 is opened, the controller 22 may allow the water supply valve 7 to be shut. The first water level needs to be high enough for at least part of the filter 14 to be soaked.

Since soils are usually stuck to the components located under the inner tub 3 or outer tub 2, they need to be soaked for quite a while so as to be removed. Hereinafter, the length of time of the lower portion soaking step is referred to as 'lower portion soaking time'. While the lower portion soaking step may be carried out for a few hours while the driving part 18 is not running. In some implementations, the driving part 18 may be run intermittently. In the lower portion soaking step, soils especially on the bottoms of the filter 14, hub 12, and outer tub 2, are soaked intensively.

After completion of the lower portion soaking step, the upper and lower portion soaking step may be carried out. Once the upper and lower portion soaking step is started, the controller 22 may open the water supply valve 7 again to feed water, and shut the water supply valve 7 when the water level detection means detects that the water level in the outer tub 2 gradually rises from the first level and reaches a second level. In some implementations, water may be fed to the second level after the drain pump 9 is actuated and drains water from the outer tub 2 after the lower portion soaking step.

Referring to FIG. 7, the controller 22 may control the driving part 18 such that the inner tub 3 and the pulsator 4 continuously rotate together (full spin mode) in one direction and then stop in a repeated manner, until after a given period of time (hereinafter, 'upper and lower portion soaking time') since the start of the upper and lower portion soaking step. In some implementations, when the inner tub 3 in the stopped state rotates again, the driving part 18 may rotate in the direction opposite to the direction it has previously rotated.

As illustrated in FIG. 7, in the upper and lower portion soaking step, water rises along the space between the inner tub 3 and the outer tube 2 by a centrifugal force generated by the rotation of the inner tub 3. In some implementations, water should not reach the top edge of the inner tub 3. To this end, the rotation speed of the driving part 18 needs to be set to a moderate level, taking the water level in the outer tub 2 into account.

In the upper and lower portion soaking step, a flow of water is generated and moves outward radially from the center of the inner tub 3 by centrifugal force. Since the flow of water also circulates between the pulsator 4 and the hub 12, contaminants on the filter 14—especially, soils stuck in the collection bag 14*b*—may be removed by the water circulation. Also, the upper portion of the inner tub 3 and the upper portion of the outer tub 2 may be cleaned up by the flow of water that rises by centrifugal force. Hereinafter, a flow of water generated by the rotation of the inner tub 3 in the upper and lower portion soaking step is referred to as 'pushing flow of water'.

The rotation speed of the inner tub 3 in the upper and lower portion soaking step is set out of a speed range where resonance occurs and, in some implementations, ranges approximately between 170 to 180 rpm. The driving part 18's rotation for forming a pushing flow of water may occur repeatedly during the upper and lower portion soaking step. For example, the controller 22 may rotate the driving part 18 continuously for a predetermined period of time and stop it, and then the driving part 18 may remain stopped for a predetermined period of time and rotate again under control of the controller 22 in a repeated manner. Repeated rotation of the driving part 18 may occur periodically, e.g., until after a given period of time (hereinafter, 'upper and lower portion soaking time') since the start of the upper and lower portion soaking step. For example, the rotation of the driving part 18 may repeat every five minutes.

Figure 8:
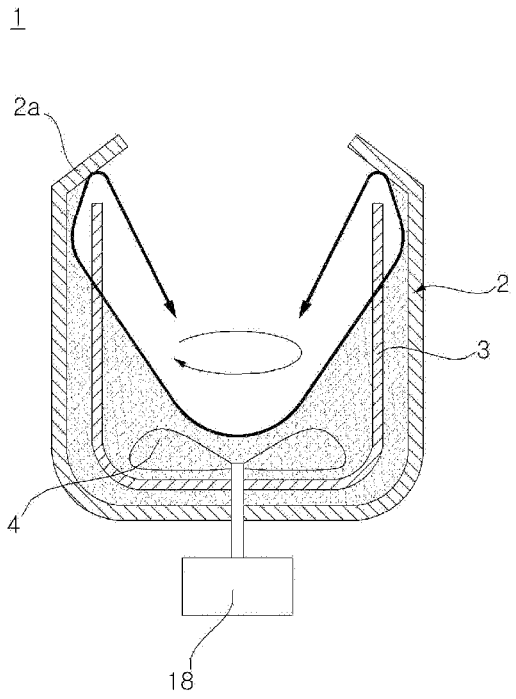
Figure 9:
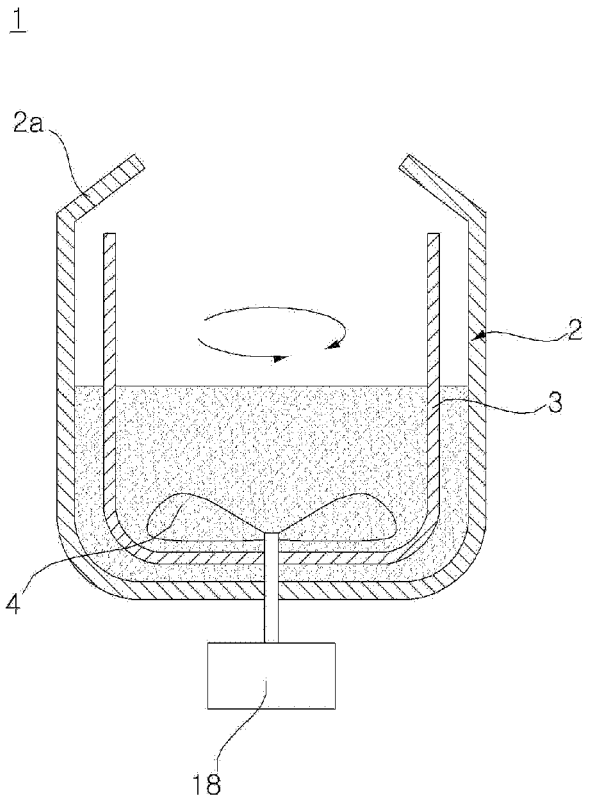
Figure 10:
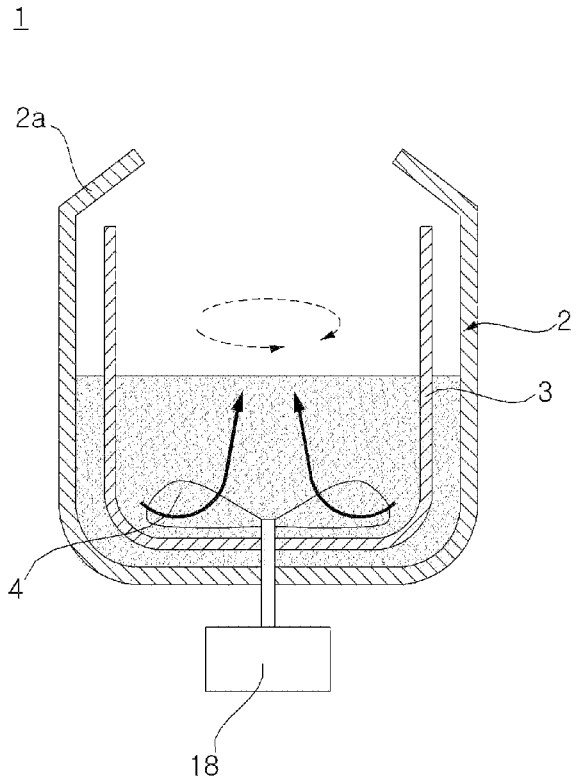

FIGS. 8 to 10 illustrate example cleaning patterns in individual steps of a contaminant removal stroke. FIG. 8 illustrates an example cleaning pattern in a first step, FIG. 9 illustrates an example cleaning pattern in a second step, and FIG. 10 illustrates an example cleaning pattern in a third step.

The contaminant removal stroke may include a first step of rotating the inner tub 3 such that water rises along the space between the outer tub 2 and the inner tub 3 and then overflows the top edge of the inner tub 3 to pour into the inner tub 3, a second step of repeatedly rotating and stopping the inner tub 3, and a third step of rotating only the pulsator 4 alternately in two opposite directions while the inner tub 3 remains stopped.

Referring to FIG. 8, the first step is carried out while the water level in the outer tub 2 is at a third level, which is higher than the second level. After completion of the soaking stroke, the controller 22 opens the water supply valve 7 to feed water into the outer tub 2, and shuts the water supply valve 7 when the water level detection means detects that the water level in the outer tub 2 gradually rises from the second level and reaches the third level. In some implementations, water may be fed to the third level after the drain pump 9 is actuated and drains water from the outer tub 2 after the soaking stroke.

In the first step, the inner tub 3 may rotate continuously in one direction for a predetermined period of time (full spin mode). In this procedure, a flow of water (see FIG. 8; hereinafter, 'centrifugal flow of water') is formed which rises along the space between the outer tub 2 and the inner tub 3 and then is guided along the cover 2*a* to overflow the top edge of the inner tub 3 to pour into the inner tub 3. The rotation speed of the inner tub 3 for generating a centrifugal flow of water is set taking the water level in the outer tub 2 into account.

In some implementations, the driving part 18 may rotate at a higher speed in the first step than in the upper and lower portion soaking step. That is, the driving part 18 rotates with the water level being higher in the first step than in the upper and lower portion soaking step. Due to this, if the water level (third level) in the outer tub 2 rises high enough by water supply, a centrifugal flow of water may be formed even if the inner tub 3 rotates at the same speed as in the upper and lower portion soaking step or even at a lower speed.

In some implementations, the rotation speed of the inner tub 3 in the first step ranges from 170 to 180 rpm.

In the first step, as is with the upper and lower portion soaking step, the components located under the inner tub 3 and the outer tub 2 may be cleaned up, and the inner upper portions of the inner tub 3 and outer tub 2, as well as the outer upper portions, may be cleaned up by a strong flow of water pouring into the inner tub 3.

Referring to FIG. 9, the second step is carried out after the first step, and the inner tub 3 rotates and stops repeatedly. In the second step, the inner tub 3 rotates at a speed at which no centrifugal flow of water is generated. Accordingly, the rotation speed of the inner tub 3 in the second step is, in some implementations, lower than that in the first step.

Even if soils are stuck again to the inner tub 3 due to a flow of water (pushing flow of water or centrifugal flow of water) that is generated before the second step and moves outward radially by centrifugal force, the soils may be separated from the inner tub 3 by inertia as the inner tub 3 rotates and stops repeatedly in the second step.

In some implementations, the inner tub 3 may rotate alternately in two opposite directions in the second step. Although the inner tub 3 may rotate alternately in two opposite directions in the upper and lower portion soaking step as well, as described above, the direction may be changed more quickly in the second step than in the upper and lower portion soaking step. By quickly changing the direction of rotation of the inner tub 3, soils may be separated well from the inner tub 3 by inertia.

Referring to FIG. 10, the third step is carried out after the second step, and the pulsator 4 rotates alternately in two opposite directions while the inner tub 3 remains stopped (agitation mode). By designing the pulsator 4 in a proper shape, an upward flow may be formed in the inner tub 3 by the rotation of the pulsator 4. In some implementations, the water in the outer tub 2 flows into the inner tub 3 via the filter holes 14*h* and the through holes 12*h* in the hub 12. The soils stuck on the rear surface of the pulsator 4 or the upper surface of the filter 14 may be removed through the third step, and the soils present in the outer tub 2 may be collected by the filter 14.

After the third step that is carried out for a predetermined period of time, the controller 22 may actuate the drain pump 9 to drain water from the outer tub 2. After completion of the drainage, water may be fed again, and the first, second, and third steps may be carried out sequentially. This process may be repeated a preset number of times.

Hereinafter, the following Table 1 shows how the self-cleaning course is configured depending on the cumulative number of times the cycle has been run.

TABLE 1

| Soaking stroke | | | | | |
|---|---|---|---|---|---|
| Lower portion soaking | Upper and lower portion soaking | Total soaking time | Contaminant removal stroke | Total self-cleaning time | Cumulative number of times wash cycle has been run |
| 2 hours | none | 2 hours | 1 hour | 3 hours | 30 times (in a month) |
| 4 hours | none | 4 hours | 1 hour | 5 hours | 60 times (in two months) |
| 5 hours | 1 hour | 6 hours | 1 hour | 7 hours | 120 times (in four months) |
| 7 hours | 1 hour | 8 hours | 1 hour | 9 hours | 240 times (in eight months) |
| 9 hours | 1 hour | 10 hours | 1 hour | 11 hours | 360 times (in twelve months) |

The cumulative number of times the cycle has been run may be divided into several ranges according to a predetermined criterion, and the storage part 26 may store information about settings for the self-cleaning course for each of the several ranges. The information about settings for the self-cleaning course may include information about strokes of the self-cleaning course and information about the length of time of each stroke. For example, as summarized in Table 1, the cumulative number of times the cycle has been run may be divided into a first range (0 to 30 times), a second range (30 to 60 times), a third range (60 to 120 times), a fourth range (120 to 240 times), and a fifth range (240 to 360 times), and the storage part 26 may store information about strokes of the self-cleaning course for each of the ranges and information about the length of time of each stroke. Furthermore, the storage part 26 may store information about the length of time of each step of each stroke.

The controller 22 may configure the self-cleaning course based on the information about settings for the self-cleaning course for the range in which the cumulative number of times the cycle has been run stored in the step S30 (see FIG. 4) falls.

A survey showed that users run the wash cycle approximately 30 times a month. As discussed above, the cumulative number of times the cycle has been run is the total number of times the wash cycle has been run since the last time the self-cleaning course was conducted. Hence, it can be estimated that, the greater the cumulative number of times the cycle has been run, the longer the time elapsed since the last time the self-cleaning course was conducted. Accordingly, there is a need to configure the self-cleaning course in such a way as to allow for more powerful cleaning. Specifically, the strokes or steps of the self-cleaning course may be changed, or the self-cleaning time may be increased or decreased.

Because each stroke or step of the self-cleaning course is distinctive in terms of the cleaning effect, diversification of strokes or steps of the self-cleaning course or increasing the length of time of each stroke or step may allow better removal of contaminants, but there is still the drawback that the total length of time of self-cleaning also increases. In view of this, if the level of contamination is assessed as relatively low, the controller 22 may configure the self-cleaning course to exclude the upper and lower portion soaking step. That is, if the cumulative number of times the cycle has been run is below a preset reference value, the controller 22 may configure the soaking stroke to exclude the upper and lower portion soaking step. In some implementations, the reference value is set to 60.

In some implementations, the greatest amount of time in the self-cleaning course is spent on soaking soil. Thus, the lower portion soaking step takes up the largest portion of the total length of time of the self-cleaning course. Accordingly, the controller 22 may manage the time spent on the self-cleaning course more efficiently, as well as the cleaning effect. In view of this, the length of time of the soaking stroke (for example, lower portion soaking time) may be set to increase toward a higher range in which the cumulative number of times the cycle has been run falls. In some implementations, the lower portion soaking time increases as the range goes higher from the first range toward the fifth range, and as a result, the time (self-cleaning time) taken for the self-cleaning course for each range also increases in the same pattern as the lower portion soaking time.

Figure 11:
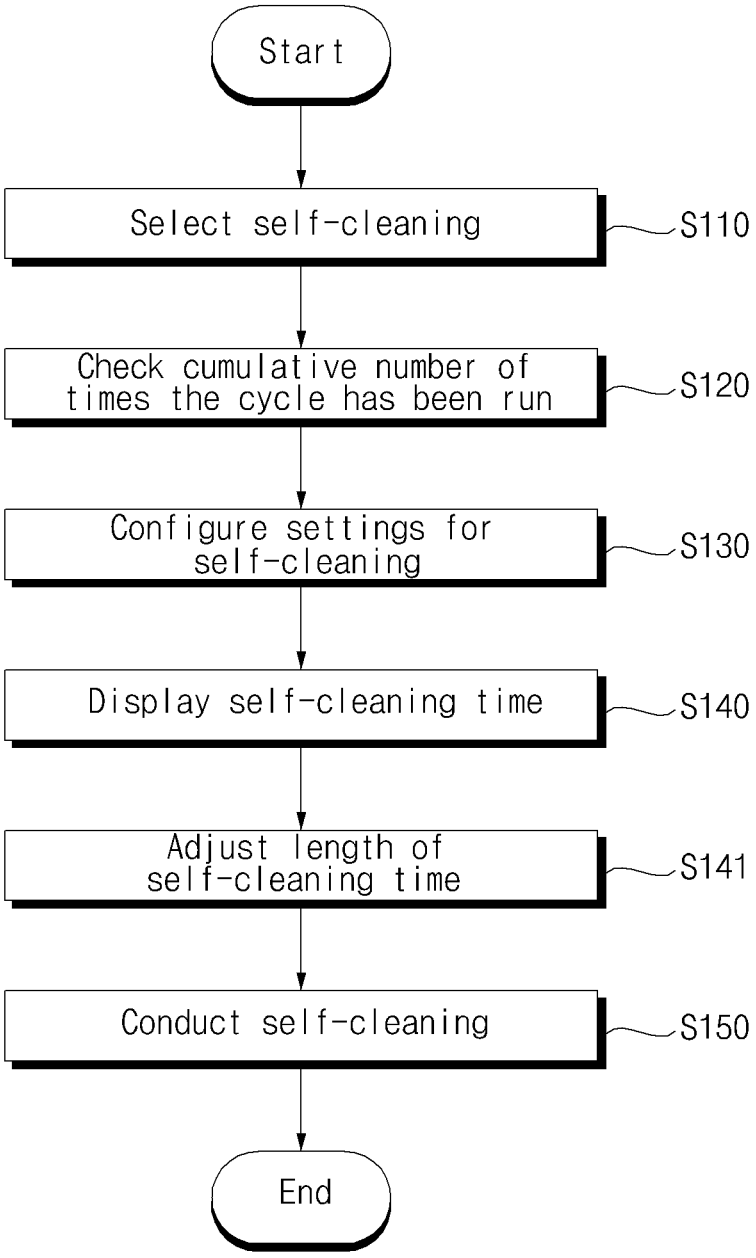
FIG. 11 is an example control method for a washing machine.

FIG. 11 illustrates an example control method for a washing machine. Referring to FIG. 11, the control method for a washing machine includes a step S141 of adjusting the length of the self-cleaning time.

When the self-cleaning time is displayed through the display part 24, the user may check it and then adjust the length of the self-cleaning time through the self-cleaning setting part 31 (S141). The controller 22 may configure the self-cleaning course based on the length of the self-cleaning time adjusted in the step S141. For example, if the user sees the self-cleaning time of 7 hours, which is displayed on the display part 24 in the step S140, and enters 5 hours through the self-cleaning setting part 31, the controller 22 may configure the self-cleaning course with settings for the self-cleaning time of 5 hours in Table 1. Accordingly, the controller 22 may configure the self-cleaning course to include the upper portion soaking step (4 hours) and the contaminant removal stroke (1 hour) and exclude the upper and lower portion soaking step based on the length of the self-cleaning time (5 hours) adjusted by the user, rather than configuring the self-cleaning course to include the soaking stroke consisting of the lower portion soaking step (5 hours) and the upper and lower portion soaking step (1 hour) and the contaminant removal stroke (1 hour) based on the 7 hours displayed on the display part 24 in the step S140, and may conduct the configured self-cleaning course (S150).

Even if the controller 22 configures the self-cleaning course properly based on the cumulative number of times the cycle has been run and suggests it to the user through the display part 24 in the step S140, the user may increase or decrease the self-cleaning time as necessary so that various requirements for the user can be met.

The control method for a washing machine allows for changing the steps of the self-cleaning course or adjusting the length of time of each stroke, depending on how heavily the washing machine is contaminated. This will bring out a self-cleaning performance based on the level of contamination and adjust the time spent on self-cleaning.

Moreover, the control method for a washing machine offers the advantage that it requires no device for detecting the level of contamination, because it can calculate the cumulative number of times the wash cycle has been run and estimate how heavily the washing machine is contaminated based on the cumulative number of times the wash cycle has been run.

What is claimed is:

1. A control method for a washing machine, the washing machine comprising:

an outer tub that is configured to holding water;

an inner tub that is located within the outer tub, that is configured to exchange water with the outer tub, and that is configured to rotate;

a pulsator that is located in a lower portion of the inner tub and that is configured to rotate an input part; and a display part, the method comprising:

each time that a wash cycle runs after a previous self-cleaning course, storing a cumulative number of times the wash cycle has run since the previous self-cleaning course;

selecting a subsequent self-cleaning course in response to receiving, through the input part, a selection of the subsequent self-cleaning course;

setting a length of time of the subsequent self-cleaning course based on the stored cumulative number of times the wash cycle has run since the previous self-cleaning course; and conducting the subsequent self-cleaning course for the length of time;

displaying the length of time of the subsequent self-cleaning course on the display part; and after displaying the length of time of the self-cleaning course through the display part, configuring the input part to receive an adjustment to the length of time of the subsequent self-cleaning course.

2. The method of claim 1, wherein the length of time of the subsequent self-cleaning course is directly related to the cumulative number of times the wash cycle has run since the previous self-cleaning course.

3. The method of claim 1, wherein displaying the length of time of the self-cleaning course is in response to selecting the subsequent self-cleaning course.

4. The method of claim 1, further comprising:

receiving, through the input part, an adjusted length of time of the subsequent self-cleaning course.

5. The method of claim 4, wherein, conducting the subsequent self-cleaning course comprises conducting the subsequent self-cleaning course based on the adjusted length of time of the subsequent self-cleaning course.

6. A control method for a washing machine, the washing machine comprising:

an outer tub that is configured to holding water;

an inner tub that is located within the outer tub, that is configured to exchange water with the outer tub, and that is configured to rotate; and a pulsator that is located in a lower portion of the inner tub and that is configured to rotate, the method comprising:

each time that a wash cycle runs after a previous self-cleaning course, storing a cumulative number of times the wash cycle has run since the previous self-cleaning course;

selecting a subsequent self-cleaning course;

configuring settings of the subsequent self-cleaning course based on the stored cumulative number of times the wash cycle has run since the previous self-cleaning course; and conducting the subsequent self-cleaning course, wherein the washing machine further comprises:

a storage part that is configured to assign the cumulative number of times the wash cycle has run since the previous self-cleaning course into one of one or more ranges according to a predetermined criterion and that is configured to store information about the settings for the subsequent self-cleaning course for each of the one or more ranges, wherein the information about the settings for the subsequent self-cleaning course for each of the one or more ranges comprises information about strokes of the subsequent self-cleaning course and information about a length of time of each stroke, and wherein configuring the settings of the subsequent self-cleaning course further comprises:

determining a range, from the one or more ranges, in which the cumulative number of times the wash cycle has run since the previous self-cleaning course is located; and configuring the settings of the subsequent self-cleaning course based on the determined range.

7. The method of claim 6, wherein the self-cleaning course comprises at least one of:

a soaking stroke that comprises providing water to the outer tub and retaining water in the outer tub for a predetermined period of time, or a contaminant removal stroke that comprises rotating at least one of the inner tub or the pulsator and draining water from the outer tub, wherein the settings for the subsequent self-cleaning course comprise settings for a length of time of the soaking stroke for each of the one or more ranges, and wherein the length of time of the soaking stroke for each of the one or more ranges is directly related to the cumulative number of times the wash cycle has run since the previous self-cleaning course.

8. The method of claim 7, wherein the soaking stroke comprises:

providing water to fill the outer tub and the inner tub to a first level;

retaining water in the outer tub and the inner tub for a lower portion soaking time;

providing water to fill the outer tub to a second level that is higher than the first level; and repeatedly rotating and stopping the inner tub for a given period of time after an upper portion soaking time and the lower portion soaking time, wherein a duration of the soaking stroke comprises at least the lower portion soaking time.

9. The method of claim 7, wherein, based on the cumulative number of times the wash cycle has run since the previous self-cleaning course being less a reference value, configuring the settings of the subsequent self-cleaning course comprises:

providing water to fill the outer tub and the inner tub to a first level; and retaining water in the outer tub and the inner tub for a lower portion soaking time.

10. The method of claim 7, wherein, based on the cumulative number of times the wash cycle has run since the previous self-cleaning course being equal to or greater than a reference value, configuring the settings of the subsequent self-cleaning course comprises:

providing water to fill the outer tub and the inner tub to a first level;

retaining water in the outer tub and the inner tub for a lower portion soaking time;

providing water to fill the outer tub to a second level that is higher than the first level; and repeatedly rotating and stopping the inner tub for a given period of time after an upper portion soaking time and the lower portion soaking time.

11. The method of claim 7, wherein the contaminant removal stroke comprises:

overflowing water from the outer tub to the inner tub by rotating the inner tub;

repeatedly rotating and stopping the inner tub; and reciprocating the pulsator while the inner tub is stopped.

12. The method of claim 10, wherein the contaminant removal stroke further comprises:

after reciprocating the pulsator, draining water from the outer tub.

13. The method of claim 12, further comprising:

after draining water from the outer tub:

providing water to the outer tub;

overflowing water from the outer tub to the inner tub by rotating the inner tub;

repeatedly rotating and stopping the inner tub; and reciprocating the pulsator while the inner but is stopped.

* * * * *